United States Patent [19]

Gilroy

[11] 4,437,611

[45] Mar. 20, 1984

[54] SELF PROTECTING SPRAY NOZZLE

[75] Inventor: Alfred A. Gilroy, Richmond, Canada

[73] Assignee: MacMillan Bloedel Limited, Vancouver, Canada

[21] Appl. No.: 410,817

[22] Filed: Aug. 23, 1982

Related U.S. Application Data

[63] Continuation of Ser. No. 181,408, Aug. 26, 1980, abandoned.

[30] Foreign Application Priority Data

Oct. 10, 1979 [GB] United Kingdom ..... 7935179

[51] Int. Cl.[3] ..... B05B 1/32; B05B 12/12; B05B 13/06

[52] U.S. Cl. ..... 239/453; 239/506; 239/600; 239/DIG. 19; 169/37

[58] Field of Search ..... 239/451–453, 239/456, 459, 506, 516, 533.1, 570, 583, DIG. 19, 600; 169/51, 54, 37

[56] References Cited

U.S. PATENT DOCUMENTS

| | | | |
|---|---|---|---|
| 945,867 | 1/1910 | Richter | 239/506 X |
| 1,491,915 | 4/1924 | McLaine | 239/453 X |
| 3,034,728 | 5/1962 | Hruby, Jr. | 239/206 |
| 3,081,952 | 3/1963 | Woodward et al. | 239/453 X |
| 3,091,398 | 5/1963 | Hruby, Jr. | 239/206 |
| 3,267,959 | 8/1966 | Savage | 239/453 X |
| 3,297,261 | 1/1967 | Heintz | 239/453 X |
| 3,421,701 | 1/1969 | Walters | 239/453 |
| 3,539,112 | 11/1970 | Thompson | 239/452 |
| 3,863,844 | 2/1975 | McMillan | 239/452 |
| 3,904,125 | 9/1975 | Allenbaugh | 239/452 |
| 3,948,285 | 4/1976 | Flynn | 137/494 |
| 3,999,570 | 12/1976 | Clements | 137/517 |
| 4,082,067 | 4/1978 | Yanagihara | 239/453 X |
| 4,172,559 | 10/1979 | Allenbaugh, Jr. | 239/453 |

FOREIGN PATENT DOCUMENTS

| | | | |
|---|---|---|---|
| 317128 | 11/1931 | Canada . | |
| 483941 | 6/1952 | Canada . | |
| 484914 | 7/1952 | Canada . | |
| 549795 | 12/1957 | Canada . | |
| 643754 | 6/1962 | Canada . | |
| 816588 | 7/1969 | Canada . | |
| 819611 | 8/1969 | Canada . | |
| 842096 | 5/1970 | Canada . | |
| 868794 | 4/1971 | Canada . | |
| 873764 | 6/1971 | Canada . | |
| 931997 | 8/1973 | Canada . | |
| 990326 | 6/1976 | Canada . | |
| 1007271 | 3/1977 | Canada . | |
| 1055074 | 5/1979 | Canada . | |
| 1176926 | 8/1964 | Fed. Rep. of Germany | 239/453 |
| 2323846 | 11/1973 | Fed. Rep. of Germany . | |

OTHER PUBLICATIONS

Harper, Charles A., Handbook of Plastics and Elastomers, 1975, McGraw-Hill Book Co., pp. 1–87, 88, 94; 3–28, 30, 41, 42, 45–47; 4–29, 30.

Phillips Chemical Co. (Bartlesville, OK 74004), Technical Service Memorandum (TSM 258) "Ryton® Polyphenylene Sulfide for injection Molding", Nov. 1976.

*Primary Examiner*—Andres Kashnikow

*Attorney, Agent, or Firm*—Larson and Taylor

[57] ABSTRACT

A spray nozzle is disclosed for a sprinkler system in a corrosive or dirty environment. The spray nozzle of the present invention retains its operability over known types of spray nozzles, particularly when used in hot environments or in corrosive, dirty environments. The spray nozzle has a tubular body formed from heat resistant thermoplastic material with an inlet at one end and an outlet orifice at the other end. A plunger is provided formed from heat resistant thermoplastic material having a stem slidably mounted within the tubular body, the plunger having an enlarged head at one end of the stem located outside the tubular body and adjacent the outlet orifice, and a thermoplastic spring within the tubular body to normally bias the plunger stem in a direction toward the inlet to have the plunger head close the outlet orifice, the spring capable of being overcome by water under pressure entering the inlet of the tubular body, and acting on the plunger head from within the tubular body to move the plunger head away from the tubular body to open the outlet orifice.

4 Claims, 5 Drawing Figures

SELF PROTECTING SPRAY NOZZLE

This is a continuation of the application Ser. No. 181,408 filed Aug. 26, 1980, now abandoned.

The present invention relates to an improved spray nozzle.

Spray nozzles for sprinkler systems are well known. The nozzles are normally provided with a plurality of small orifices or a single orifice with a deflector to direct a spray of water outwardly from the nozzle when a valve in a line, bringing water to the nozzle, is opened by suitable means such as a heat sensor.

When used in a corrosive, dirty environment the known spray nozzles, particularly their orifices, quickly become corroded or clogged thereby reducing their effectiveness, or even becoming inoperative. Frequent maintenance and replacement of the nozzles is therefore necessary. In order to reduce maintenance and replacement costs, the nozzles are usually made from stainless steel when they are to be used in a difficult corrosive environment. However, stainless steel nozzles are initially very expensive, and even stainless steel nozzles can become corroded and clogged after a number of years of use in a corrosive environment.

It is a purpose of the present invention to provide an improved spray nozzle which retains its operability over a much longer period of time than known nozzles, particularly when employed in hot environments or in corrosive, dirty environments. It is another purpose of the present invention to provide such an improved spray nozzle simply and relatively inexpensively when compared to the cost of known stainless steel nozzles.

In accordance with the present invention the improved spray nozzle has a nozzle body provided with a relatively large water outlet orifice at one end. Means are provided on the nozzle for, normally, tightly closing the outlet orifice from inside the nozzle body. The closing means are resiliently biased to the closed position. Thus the outlet orifice and the interior of the nozzle are protected from any corrosive, dirty environment in which the nozzle may be installed. When water under pressure is provided to the nozzle body from an inlet, the water moves the closing means a short distance against the resilient biasing force to slightly open the outlet orifice so that water can be sprayed out of the outlet orifice. The closing means is shaped so that when moved a short distance away from the outlet, it acts as a deflector and the water forms a wide spray as it leaves the nozzle.

Further in accordance with the present invention it has been found that the improved spray nozzle can be constructed from suitable known thermoplastic materials without reducing its effectiveness. The novel construction lends itself to the use of thermoplastic materials which are not affected by high temperatures or by a corrosive environment. The use of suitable thermoplastic materials reduces both the initial cost of the nozzles and, more importantly, their maintenance cost.

The invention is particularly directed toward a spray nozzle having a tubular body formed from heat resistant thermoplastic material with an inlet at one end and an outlet orifice at the other end. The spray nozzle has a plunger formed from heat resistant thermo-plastic material with the stem of the plunger slidably mounted within the tubular body. The plunger has an enlarged head at one end of the stem located outside the tubular body and adjacent the outlet orifice. Thermoplastic spring means within the tubular body normally bias the plunger stem in a direction toward the inlet to have the plunger head close the outlet orifice. The spring means can be overcome with water under pressure entering the inlet of the tubular body and acting on the plunger head from within the tubular body to move the plunger head away from the tubular body to open the outlet orifice.

In one embodiment of the present invention, the tubular body and spray nozzle are made from polyphenylene sulphide. In another embodiment the spring means is a coiled spring made from a ribbon of polyester material.

In drawings which illustrate embodiments of the invention:

Figure 1:
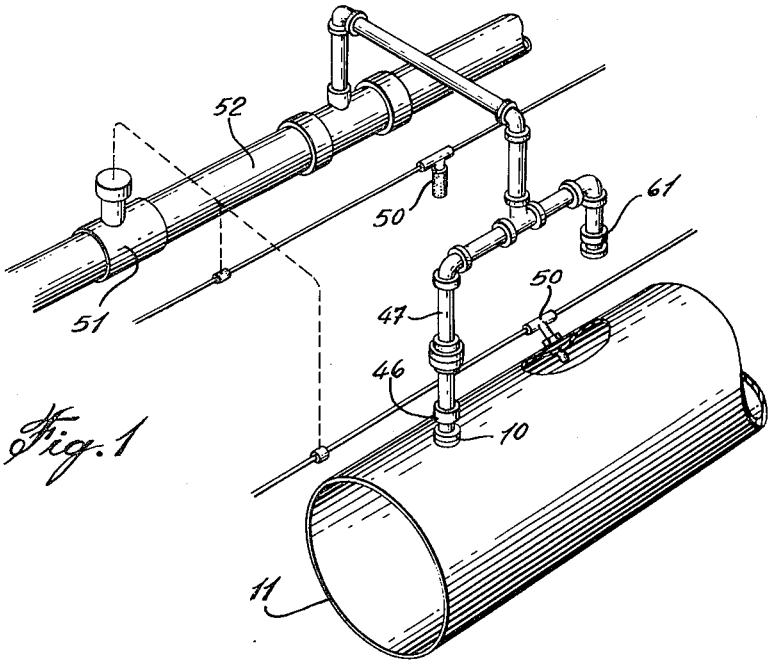
FIG. 1 is an isometric view of a portion of a sprinkler system showing a spray nozzle of the present invention mounted within a conduit.
Figure 2:
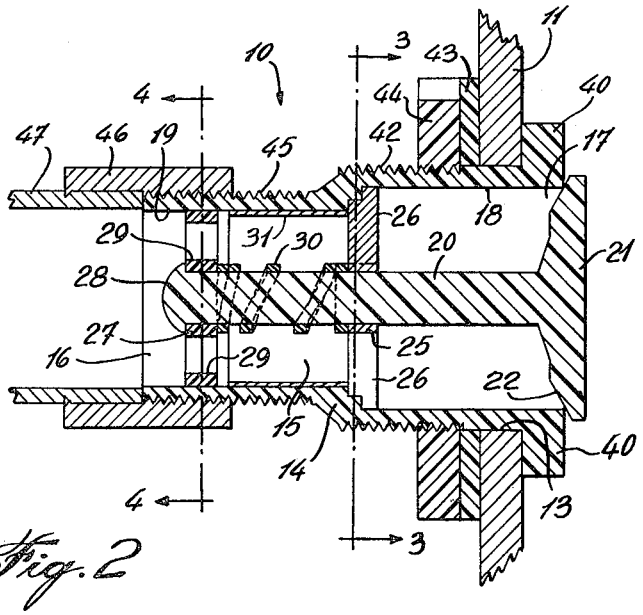
FIG. 2 is a cross-sectional view of one embodiment of a spray nozzle according to the present invention.
Figure 3:
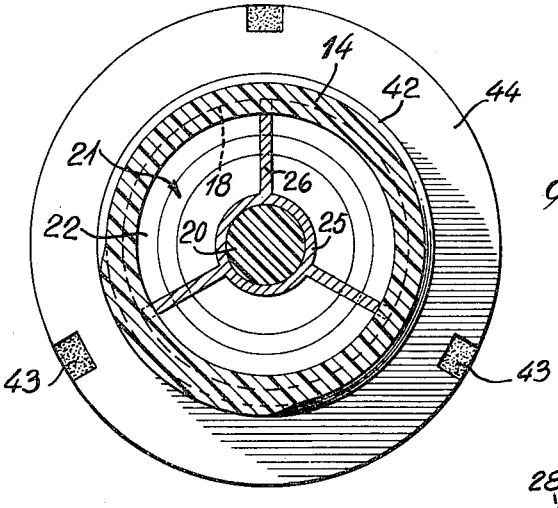
FIG. 3 is a cross-sectional view taken along line 3—3 of FIG. 2.

The spray nozzle 10 of the present invention is adapted to be mounted within a conduit wall 11 as shown in FIGS. 1 and 2. The nozzle 10 is mounted through a hole 13 in the wall 11 with a minor portion containing the outlet orifice of the nozzle 10 located within the conduit and with a major portion outside the conduit.

In more detail, the spray nozzle 10 has a cylindrical nozzle body 14. The front portion of the body 14 is slightly larger in outside diameter than the rear portion. A central bore 15 extends through the body 14 providing an inlet 16 and an outlet orifice 17. The central bore 15 is stepped in the area where the front and rear body portions meet to provide a front bore portion 18 having a larger diameter than a rear bore portion 19.

A plunger 20 is slidably mounted within the body 14. The plunger 20 is axially mounted within the body 14 and has an enlarged head 21 located outside the body 14 and attached to one end of the plunger 20. The head 21 has a disk-like shape and is slightly larger in diameter than the outlet orifice 17 at the end of the front bore portion 18. A bevelled surface 22 is provided on the head 21 at the outlet orifice 17, to spray water outward from the nozzle 10.

Means are provided to mount the plunger 20 for sliding movement within the central bore 15 of the body 14. The mounting means includes a cylindrical fixed bushing 25 mounted concentrically within the central bore 15 at the step between the front bore portion 18 and the rear bore portion 19. Arms 26 fixed to the bushing 25 extend radially therefrom and are fixed at their ends to the central bore 15 to hold the bushing 25 fixed in place. The plunger 20 passes snugly through the bushing 25.

Figure 4:
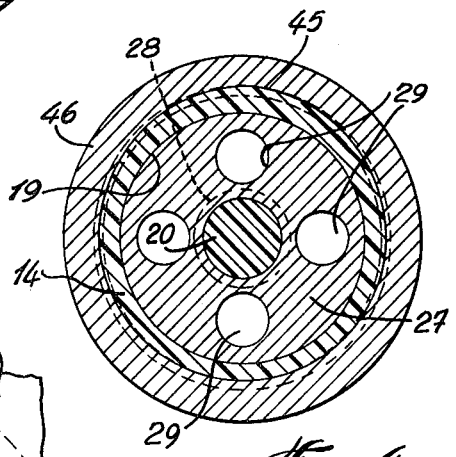
FIG. 4 is a cross-sectional view taken along line 4—4 of FIG. 2.

The plunger mounting means also includes a disk 27 fixed concentrically on the free end 28 of the plunger 20 as shown in FIGS. 2 and 4. The disk 27 is sized to fit snugly within the rear bore portion 19 of the body 9 and to hold the plunger 20 centered within the rear bore portion 19. A plurality of holes 29 are provided in the disk 27 about the free end 28 of the plunger 20. Both the disk 27 which is movable within the rear bore portion 19 and the fixed bushing 25 guide the plunger 20 for axial sliding movement within the body 14 of the spray nozzle 10.

A coil spring 30 is loosely mounted about the plunger 20 between the fixed bushing 25 and disk 27. The spring 30 normally acts to hold disk 27 apart from bushing 25 to close the outlet orifice 17 by having the bevelled surface 22 on the plunger head 21 contacting the edge of the front bore portion 18. A thin sleeve 31 is snugly mounted concentric within the rear bore portion 19 of the body 14. One end of the sleeve 31 normally abuts against the fixed arms 26 holding the bushing 25 in place. The other end of the sleeve is spaced slightly from the movable disk 27 when the plunger 20 is closed. The sleeve 31 limits the movement of the plunger 20 on opening of the plunger head 21 as will be described.

Figure 5:
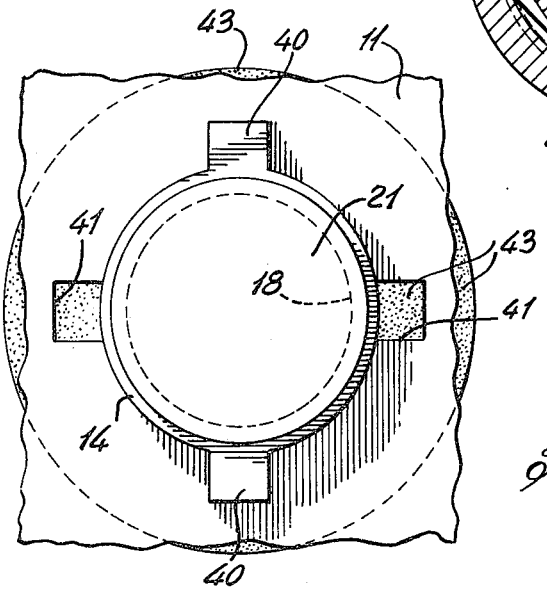
FIG. 5 is an end view of the nozzle of the present invention viewed from within the conduit.

Means are provided for detachably mounting the spray nozzle 10 in the wall of a conduit. These mounting means include a pair of mounting tongues 40 projecting outwardly in diametrically opposed fashion from the body 14 adjacent its outlet orifice 17 as shown in FIGS. 2 and 5. The spray nozzle 10 is mounted in the conduit wall 11 by first aligning the tongues 40 with a pair of diametrically opposed cutouts 41 extending radially out from one edge of hole 13 in the conduit wall 11, and then pushing the body 14 through the hole, with the tongues 40 passing through the cutouts 41. The body 14 is then rotated 90° to have the tongues 40 bear against the inner surface of the conduit wall 11. The front portion of the body 14 has a threaded surface 42 and a washer 43 contoured to fit the cylindrical surface of the conduit wall 11, is fitted over the body 14 and a nut 44 is then threaded on the threaded surface 42 to lock the body 14 in the conduit wall 11. The rear portion of the body 14 also has a threaded surface 45 to permit a fitting 46 on a water line 47 to be connected to the inlet 16 of the body 14.

Referring to FIG. 1, heat sensors 50 are shown, any one of which senses heat within the conduit 11. It opens a valve 51 to permit water to flow from a main sprinkler system water line 52 through the spray nozzle 10 and into the conduit 11. The water enters the inlet 16 of the nozzle, passes through the holes 29 in the disk 27, between the arms 26 surrounding the bushing 25, and presses against the inner surface of the plunger head 21. Once the water pressure builds up to a predetermined amount the plunger head 21 moves away from the body 14, against the force of spring 30, opening the outlet orifice 17 and allowing the water to spray into the conduit 11. The sleeve 31 limits the axial movement of the plunger 20 so that only a narrow, circular outlet slot is provided at the outlet orifice 17 of the body 14. The water sprays outwardly from the body 14 and laterally off the bevelled surface 23 into the interior of the conduit 11.

In accordance with the present invention, the entire spray nozzle is made from suitable heat resistant thermoplastic material. The main nozzle components are made from non-corrosive, high-temperature resistant thermoplastic material. Both the nozzle body 14 and the plunger 20 preferably are made from a polyphenylene sulphide resin such as that sold under the trade mark "Ryton".

The nozzle spring 30 is made from a ribbon of a suitable non-corrosive, thermoplastic material having a "memory" such as a polyester resin. The polyester spring does not corrode, and retains its resiliency to keep the nozzle closed until opened by water pressure. The bushing 25 and arms 26, the disk 27, and the washer 43 and nut 44 can also be made from suitable polyester material.

While the spray nozzle 10 has been shown as being mounted in the conduit 11 it can also be mounted out in the open to act as an open area sprinkler as shown by nozzle 61 in FIG. 1.

The embodiments of the invention in which an exclusive property or privilege is claimed are defined as follows:

1. A spray nozzle for spraying a liquid inside of a conduit through which a corrosive or dirty fluid flows comprising a tubular body formed from heat resistant thermoplastic material with a central bore, an inlet at one end and an outlet orifice at the other end, a plunger formed from heat resistant thermoplastic material having a stem slidably mounted within the tubular body, the plunger having an enlarged head at one end of the stem located outside the tubular body and adjacent the outlet orifice so that the boundaries of the outlet orifice acts as a plunger seat, a bushing fixed within the tubular body to guide the plunger stem during its movement, an apertured disk fixed to the free end of the stem within the tubular body and slidable within the body, a sleeve positioned within the tubular body between the bushing and the disk, the sleeve limiting movement of the disk toward the bushing when opening the plunger to control the size of the outlet orifice opening in the nozzle, thermoplastic spring means including a coil spring made from a ribbon of polyester material loosely positioned about the stem between the bushing and the disk to normally bias the plunger stem in a direction toward the inlet to have the plunger head close the outlet orifice, the spring means capable of being overcome by water under pressure entering the inlet of the tubular body, and acting on the plunger head from within the tubular body to move the plunger head away from the tubular body to open the outlet orifice, and a mounting means on the nozzle for use in mounting the nozzle just inside a wall of the conduit so as to interrupt the flow of fluids therein as little as possible, said mounting means including a flange laterally projecting from the plunger seat which is located inside the wall and a threaded portion on the outer surface of the nozzle body adjacent the flange for receiving a nut which is located outside of the wall.

2. The spray nozzle as claimed in claim 1 wherein said central bore includes an inlet bore portion, and a stepped-up outlet bore portion, such that said outlet bore portion and outlet orifice have a larger diameter than said inlet bore portion.

3. The spray nozzle as claimed in claim 1 wherein said tubular body includes a front portion and a rear portion, said front portion having a larger outside diameter than said rear portion and wherein said stepped-up outlet bore portion begins where said front portion and rear portion meet.

4. The spray nozzle as claimed in claim 1 wherein the nozzle body and the plunger are made from a polyphenylene sulphide resin.

* * * * *